United States Patent [19]

Knoss

[11] Patent Number: 5,035,204

[45] Date of Patent: Jul. 30, 1991

[54] HEAD RESTRAINT FOR A LIVESTOCK SQUEEZE CHUTE

[76] Inventor: Doyle Knoss, Box 3, Rockglen, Saskatchewan, Canada, S0H 3R0

[21] Appl. No.: 424,599

[22] Filed: Oct. 20, 1989

[30] Foreign Application Priority Data

Dec. 6, 1988 [CA] Canada ..... 585095

[51] Int. Cl.[5] ..... A61D 3/00

[52] U.S. Cl. ..... 119/99; 119/102

[58] Field of Search ..... 119/98, 99, 102, 114, 119/109

[56] References Cited

U.S. PATENT DOCUMENTS

| | | | |
|---|---|---|---|
| 211,408 | 1/1879 | Kampf | 119/109 |
| 346,285 | 7/1886 | Hime | 119/102 |
| 346,906 | 8/1886 | Hale | 119/114 |
| 1,373,921 | 4/1921 | Shultz | 119/102 |
| 1,560,888 | 11/1925 | Watt . | |
| 1,727,290 | 9/1929 | Jones . | |
| 2,587,160 | 2/1952 | Howe . | |
| 2,831,458 | 4/1958 | Jones . | |
| 2,848,977 | 8/1958 | Prestrud et al. | 119/99 |
| 2,902,976 | 9/1959 | Wilson | 119/114 |
| 3,580,222 | 5/1971 | Dunn | 119/102 |
| 3,691,998 | 9/1972 | Luinstra . | |
| 3,777,715 | 12/1973 | Hill et al. . | |
| 4,432,306 | 2/1984 | Rossa | 119/102 |
| 4,467,746 | 8/1984 | Waldron | 119/99 |

FOREIGN PATENT DOCUMENTS

| | | | |
|---|---|---|---|
| 309429 | 10/1918 | Fed. Rep. of Germany | 119/102 |
| 3544784 | 6/1987 | Fed. Rep. of Germany | 119/99 |
| 647203 | 7/1928 | France | 119/102 |
| 2565781 | 12/1985 | France | 119/99 |
| 2595204 | 9/1987 | France | 119/99 |

*Primary Examiner*—Paul J. Hirsch

*Attorney, Agent, or Firm*—Adrian D. Battison; Stanley G. Ade; Murray E. Thrift

[57] ABSTRACT

An attachment for a livestock squeeze chute comprises an elongate beam which can be mounted on suitable mounting brackets on the upper side rails of the squeeze chute so that the beam extends above the squeeze chute and forwardly of the front end of the squeeze chute to a position approximately four feet forward and eighteen inches upwardly from the front end. A pulley is mounted on the forward most end of the beam and a winch assembly is mounted on a support arm extending out from the beam downwardly and to one side so that the winch is available to the operator of the squeeze chute. A cable from the winch to the pulley has a free end which can be attached to a halter applied around the head of the animal so that operation of the winch pulls the head of the animal upwardly and forwardly while the animals body is maintained in the squeeze chute to assist in subduing the animal.

4 Claims, 3 Drawing Sheets

HEAD RESTRAINT FOR A LIVESTOCK SQUEEZE CHUTE

BACKGROUND OF THE INVENTION

This invention relates to an attachment for mounting on a livestock squeeze chute for more effectively restraining the head of the confined animal so as to subdue the animal and to a squeeze chute including such an attachment.

Livestock squeeze chutes are well known and manufactured in various different designs and constructions but basically they include two sides which define a channel into which the animal is driven or lead. When the animal is within the chute, various moving parts of the chute can be actuated to confine the animal so that its body is prevented from moving forwardly and rearwardly within the chute. In most cases levers are provided for actuation by the operator to open and close the chute thus confining and releasing the animal as required.

A number of previous proposals have been made showing devices for assisting in confining the head area of the animal and most of these devices act to clamp the head downwardly against a support surface.

However the conventional squeeze chute even modified by the various patent proposals leaves the animal with some possibility of movement which tends to encourage struggling.

SUMMARY OF THE INVENTION

It is one object of the present invention, therefore, to provide an improved livestock squeeze chute or an attachment which can be applied to a squeeze chute to assist in confining the animal to provide a further subduing effect on the animal.

According to a first aspect of the invention, therefore, there is provided an attachment for counting on a livestock squeeze chute of the type comprising a pair of chute sides defining a channel therebetween into which the body of an animal to be confined can be received, and means defining a front end of the chute through which the head of the animal projects when the body is confined, the attachment comprising an elongate beam, means for mounting the beam on the chute arranged to position and orient the beam to extend forwardly of the chute from above a front end of the chute, a winch, means mounting the winch for actuation by an operator at the chute, a cable having a free operating end and a captive end attached to the winch for winding thereon, and a pulley at a forward end of the beam over which the cable passes such that the free end depends from the pulley and such that actuation of the winch causes the free end of the cable to be pulled forwardly and upwardly for applying force to a halter engaging the head of the animal, whereby the head of the animal in the chute is pulled upwardly and forwardly toward the pulley to subdue the animal.

According to a second aspect of the invention, therefore, there is provided a livestock squeeze chute comprising a pair of chute sides defining a channel therebetween into which the body of an animal to be confined can be received, means defining a front end of the chute through which the head of the animal projects when the body is confined, an elongate beam, means mounting the beam on the chute extending forwardly of the chute from above the front end of the chute, a winch, means mounting the winch for actuation by an operator at the chute, a cable having a free operating end and a captive end attached to the winch for winding thereon, and a pulley at a forward end of the beam over which the cable passes such that the free end depends from the pulley and such that actuation of the winch causes the free end of the cable to be pulled forwardly and upwardly for applying force to a halter engaging the head of the animal, whereby the head of the animal in the chute is pulled upwardly and forwardly toward the pulley to subdue the animal.

The device therefore provides an arrangement which can be attached to the head of the animal for applying a force to the animal's head in a direction forwardly and upwardly from the squeeze chute to further subdue the animal. The device can be applied and removed quickly and readily by the operator from a position adjacent the operator's normal position actuating the squeeze chute levers.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
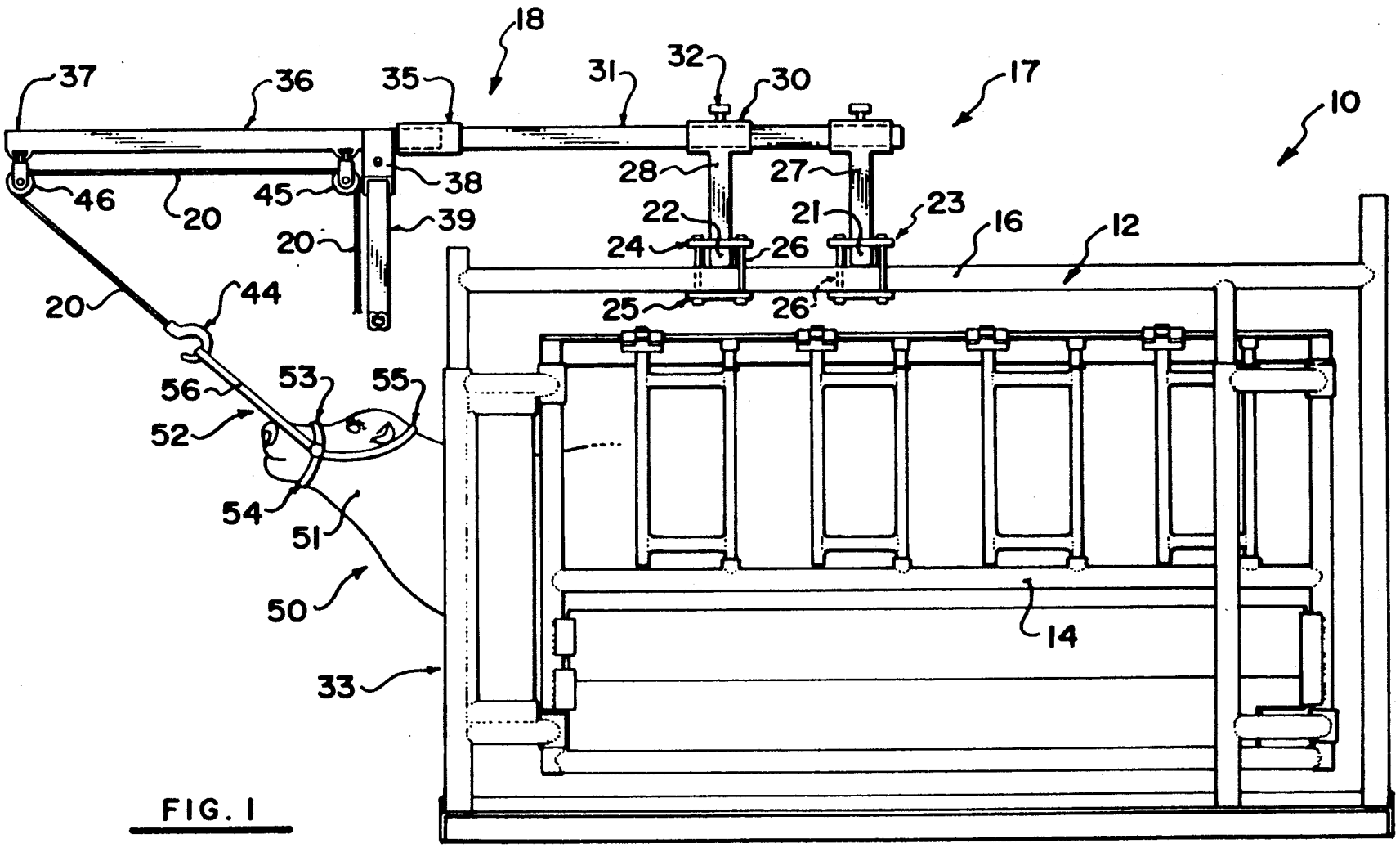
FIG. 1 is a side elevational view of a squeeze chute incorporating the attachment according to the invention.
Figure 2:
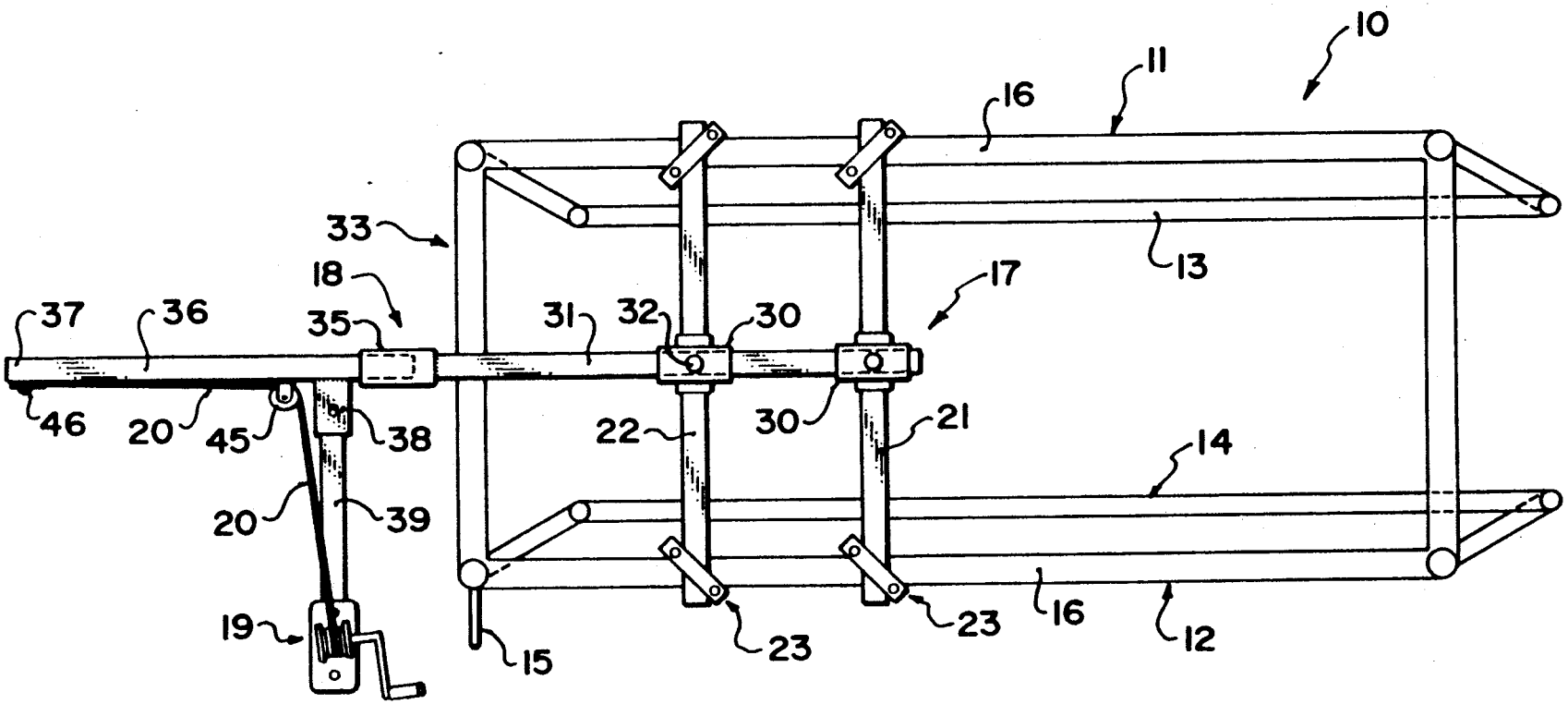
FIG. 2 is a top plan view of the squeeze chute and the attachment of FIG. 1 showing the squeeze chute only schematically.
Figure 3:
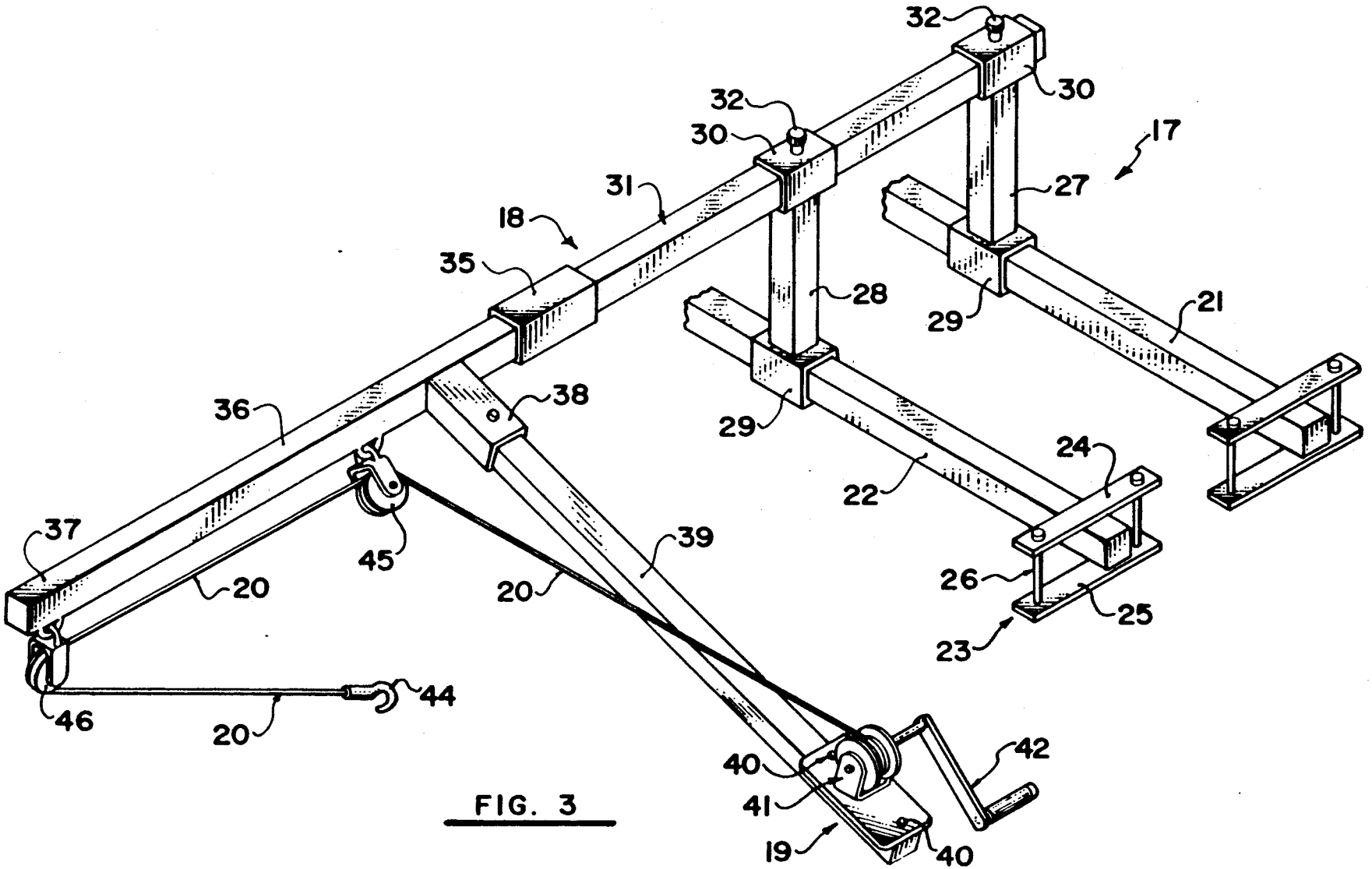
FIG. 3 is an isometric view of the attachment of FIG. 1.

A conventional squeeze chute is shown in FIGS. 1 and 2 and comprises generally a channel structure 10 defined by two sides 11 and 12 between which an animal can be lead or driven and then confined in place by squeezing the sides of the chute against the sides of the animal. For this purpose parallelogram linkages are provided which allow side bars 13 and 14 to move inwardly to clamp the animal under operation of an actuating lever schematically indicated at 15. As the details of the squeeze chute are not important in the present invention, these are shown only schematically for convenience of explanation but it will be appreciated that various different designs of squeeze chute can be employed and the details of this device will be well apparent to one skilled in the art.

In the squeeze chute arrangement shown in FIG. 1, each side 11 and 12 includes a top rail 16 forming part of the rigid structure of the squeeze chute. The attachment of the present invention is mounted on the top rails 16 and comprises a mounting assembly generally indicated at 17, an elongate beam 18, a winch assembly 19 and a cable 20.

The mounting assembly 17 includes a pair of cross members 21 and 22 which are of a length to lie over the top rails 16 with the ends projecting slightly beyond the outer sides of the top rails. Each of the cross members 21 and 22 is clamped to the top rails at a respective end by a clamping arrangement 23 defined by a pair of plates 24 and 25 arranged above and below respectively the cross member and the top rail and clamped by bolts 25.

Onto each of the cross members 21 and 22 is mounted a vertical strut 27 and 28 each of which includes a sleeve 29 at a lower end through which the cross member 21 or 22 passes. At an upper end of each of the struts there is provided a similar sleeve 30 for receiving a rear portion 31 of the beam 18. The beam portion 31 is thus a sliding fit within the sleeves 30 and is then clamped at a required location by clamping screws 32. The beam portion 31 extends forwardly from the vertical struts and is held thereby in cantilever arrangement in a horizontal direction projecting out from a front end 33 of the squeeze chute.

A forward end of the rear beam portion 31 includes a sleeve 35 welded onto the outer periphery of the beam portion. Into the sleeve is inserted as a sliding fit a front beam portion 36 so that this projects outwardly beyond the forward end of the squeeze chute to a forward most end 37 of the beam which will in practice be of the order of four feet forwardly of the front end of the squeeze chute and approximately eighteen inches above the upper rail 16.

At a rear end of the front beam portion 36 is welded a sleeve 38 which is arranged at an angle of 45° to the vertical so as to project downwardly from the beam and outwardly to one side of the beam toward one of the sides 11 and 12 of the squeeze chute. A further beam 39 is inserted into the sleeve 38 and carries at its lower end the winch assembly 19. The winch assembly is bolted by bolts 40 to the beam 39 and includes a reel 41 onto which the cable 20 can be wound together with a hand crank 42 (shown schematically) which operates to rotate the reel and thus cause winding of the cable onto the reel. The hand crank 42 can be latched at a required position to hold the reel against release and can be unlatched to allow the cable to be unwound from the reel as required. The front beam portion 36, the beam 39 and the winch assembly 19 are thus formed as a unit and can be removed by sliding forwardly from the sleeve 35 so that the squeeze chute can be used without the attachment. In this case the attachment is fully removed apart from the upper mounting assembly and the rear beam portion which do not themselves provide any encumbrance to the normal operation of the squeeze chute.

The cable 20 has one end wound upon the reel 41 and a hook 44 at a free end thereof. The cable 20 also passes over pulleys 45 and 46 mounted on the front beam portion 36 so that the cable extends along the beam 39 and then along the front beam portion 36 to the forward end 37 of the front beam portion.

In FIG. 1 an animal is shown within the squeeze chute indicated at 50 with its head 51 projecting from the forward end 33 of the squeeze chute. A halter 52 is applied around the head of the animal and includes a first portion 53 which wraps over the nose of the animal, a second portion which wraps under the jaw of the animal, and a third portion 55 which wraps around the rear of the head of the animal. The halter also includes a strap portion 56 extending forwardly from the halter which can be attached onto the hook 44.

With the animal in place in the squeeze chute, the halter is arranged on the animal's head. The halter can of course be applied previously to the introduction of the animal into the squeeze chute or can be applied when the animal is confined within the squeeze chute. The halter is then attached over the hook 44 and the operator working the lever 15 actuating the squeeze chute can reach to the winch assembly 19 to reel in the cable 20 to pull the halter tight. The positioning of the forward end of the beam thus causes the halter and the cable to be pulled upwardly and forwardly relative to the front end of the squeeze chute so that the animals head is similarly pulled in this direction until sufficient tension is applied to limit any side to side movement of the animals head. This action pulling the head of the animal in this direction causes the animal to be subdued so that it struggles less within the squeeze chute with less danger of causing damage to itself or to the operator and enabling the operator to carry out any actions upon the animal which are necessary.

The winch can be positioned at one side or the other side of the front end of the chute by inserting the front portion of the beam into the sleeve at a required orientation. For this purpose, the beam portions and the sleeve can be manufactured from square tubing so that the position of the winch is fixed by rotation of the front beam portion through 90°.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A livestock squeeze chute comprising a pair of chute sides defining a channel therebetween into which the body of an animal to be confined can be received, means defining a front end of the chute through which the head of the animal projects when the body is confined, each side having an elongate top rail extending longitudinally of the side and at right angles to the front end, an elongate beam, a pair of cross beams each extending across the channel with a respective end of each cross beam attached to a respective one of said rails so as to be supported thereby, means mounting the elongate beam on the cross beams so that the elongate beam extends forwardly therefrom and is supported thereby in cantilever manner in order that a forwardmost end of the elongate beam is located forwardly of the front end, at a height above and substantially centrally of the front end of the chute, a winch, a support arm mounting the winch for actuation by an operator at the chute, the support arm being connected to the elongate beam at a position between the cross beams and the forwardmost end and extending therefrom forwardly and to one side thereof, the winch being mounted on an end of the support arm remote from the beam, the elongate beam having attachment means thereon for attachment of the support arm thereto in a first orientation so as to extend outwardly to one side of the front end and in a second orientation so as to extend outwardly to an opposed side of the front end, a cable having a free operating end and a captive end attached to the winch for winding thereon, and a pulley at the forwardmost end of the beam over which the cable passes such that the free end depends from the pulley and such that actuation of the winch causes the free end of the cable to be pulled forwardly and upwardly for applying force to a halter engaging the head of the animal, whereby the head of the animal in the chute is pulled upwardly and forwardly toward the pulley to subdue the animal.

2. The invention according to claim 1 wherein the elongate beam comprises a front beam portion and a rear beam portion and wherein the support arm is mounted on the front beam portion, the front beam portion being removable from the rear beam portion with the support arm as an integral unit.

3. The invention according to claim 2 wherein the rear beam portion includes a sleeve coupling member into which a rear end of the front beam portion can be inserted, the sleeve coupling and the front beam portion being cooperatively shaped to allow rotation of the front beam portion from said first orientation of the winch to said second orientation of the winch.

4. The invention according to claim 1 wherein the beam mounting means comprises at least one vertical strut member extending upwardly from the cross beams, the elongate beam being attached at an upper end of the vertical member and extending forwardly therefrom in cantilever arrangement.

* * * * *